United States Patent [19]

Morrison

[11] 4,300,301

[45] Nov. 17, 1981

[54] ROTARY ACTION FIREARM SAFETY ASSEMBLY OPERABLE WITH FINGER ON THE TRIGGER

[76] Inventor: Donald C. Morrison, 60 Connellsville St., Dunbar, Pa. 15431

[21] Appl. No.: 39,450

[22] Filed: May 16, 1979

[51] Int. Cl.[3] ..... F41C 17/02

[52] U.S. Cl. ..... 42/70 E

[58] Field of Search ..... 42/70 E, 70 C, 70 R

[56] References Cited

U.S. PATENT DOCUMENTS

| | | | |
|---|---|---|---|
| 2,225,583 | 12/1940 | Blizard | 42/70 E |
| 2,379,461 | 7/1945 | Simpson | 42/70 E |
| 3,199,240 | 8/1965 | Largen | 42/70 E |

*Primary Examiner*—Charles T. Jordan

*Attorney, Agent, or Firm*—Laurence R. Brown

[57] ABSTRACT

This invention provides a readily accessible easily manipulatable improved safety assembly for a firearm that can be easily retrofit on many existing firearms without special modification or adaption. By providing rotary action from a finger actuated safety lever operable with a trigger finger maintained adjacent the trigger, a rifle or shotgun may be easily moved without awkwardness from safe to fire condition in a moment of excitement when game or a moving target appears with less chance of awkwardness or an aborted shot.

The safety assembly provides in a lateral bore through the trigger guard cage adjacent to and rearward of the pivoted trigger a rotatable barrel like member blocking rearward trigger motion in one detented position and permitting the trigger to move and release the firing pin in a second detented position where a receptacle cavity in the barrel mates with a trigger extension finger and lets the trigger pivot. A rotating lever is thus placed in a position where it can be actuated by a middle finger with the trigger finger in place and the firearm being readied for a shot.

5 Claims, 2 Drawing Figures

FIG.1
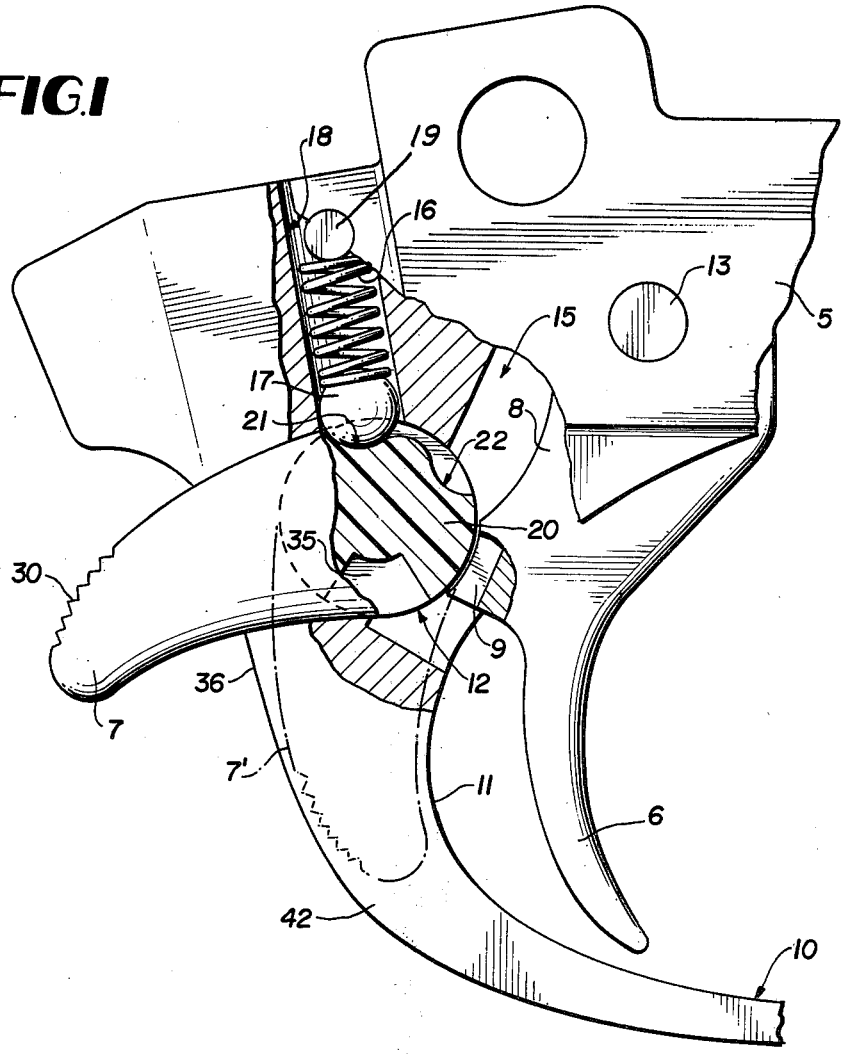
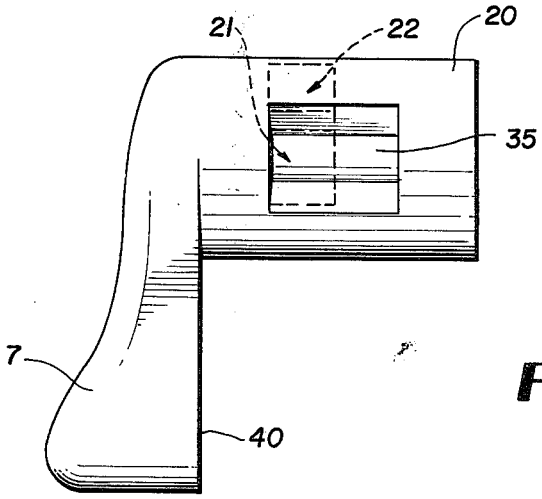
FIG.2

ROTARY ACTION FIREARM SAFETY ASSEMBLY OPERABLE WITH FINGER ON THE TRIGGER

TECHNICAL FIELD OF THE INVENTION

This invention relates to firearms, and more particularly it relates to firearm safety trigger lock assemblies.

BACKGROUND ART AND CONDITIONS

Safeties for firearms are provided in the prior art for various usage conditions and differing firearm trigger mechanisms. The primary purpose of the safety mechanism of this invention is to provide a safe trigger interlock on a rifle or shotgun with convenient and improved access for release when used for hunting and trap or skeet. Thus, the safety interlock can be left on for complete safety until game is observed or a clay target is about to be released. There is no known prior art safety assembly that sufficiently provides immediate and conveniently located access without use of the trigger finger. Thus for example with a hunting rifle, particularly in cold weather, a trigger finger may have to be maintained in an awkward position in a ready posture to operate the safety, thus exposing the finger to the cold. It is an object of this invention to provide a safety assembly that permits convenient operation while allowing the trigger finger to remain adjacent to the trigger in a ready posture.

Related safety mechanisms may be classified in two classes, namely axially movable bolt type action and rotary movement type action, this invention being of the latter type.

There are several deficiencies of prior art axially movable bolt type safety assemblies typified, for example, by U.S. Pat. Nos. 2,458,616, T. L. Maynor, Jan. 11, 1949; 2,225,583, C. E. Blizard, Dec. 17, 1940; 3,713,242, P. Seifried, Jan. 30, 1973; and 2,856,718, J. F. Fischer, Oct. 21, 1958. As aforesaid the primary deficiency is inaccessibility and awkwardness for use in the instant that game or a clay target appears. Thus, these prior art safety assemblies require in most cases a release of the safety by the trigger finger before grasping the trigger, and thus a good shot may be delayed or missed entirely because of the sudden excitement that may make an awkward safety movement abortive.

Furthermore, many of these types of safety assemblies are subject to wear or deterioration particularly when softer plastic materials are used which are otherwise desirable to manufacture and to move within restricted spaces without lubrication, which changes viscosity with temperature. Thus, if a safety assembly rubs metal on metal and requires lubrication it may take a different greater force to operate on a cold day than a warm day and thus change operating conditions enough to interfere with a good first shot. On the other hand, a plastic self-lubricating movable member such as "Nylon" or equivalent materials may tend to wear or indent from impact of a metallic trigger whenever the impact surfaces are over a limited contact area. Thus, a laterally movable bolt type safety assembly may present a limited area of trigger to safety lock contact.

Typical rotary type safety assemblies are found in U.S. Pat. Nos. 2,538,940, A. F. C. Henckel, Jan. 23, 1951; 3,397,474, J. A. Badali, Aug. 20, 1968; and 2,225,583, C. E. Blizard, Dec. 17, 1940, are also provided with mechanisms of limited contact area subject to wear, awkward hard to reach actuating means requiring a trigger finger to be manipulated to release the safety and construction techniques not adaptable for replacement of slide-bolt assemblies on existing firearms. It is a most important feature of the present invention for example, that it may replace directly a sliding bolt assembly as used on "Remington" or like available brand firearms, for example that of U.S. Pat. No. 2,225,583, and need not require the redesign of the firing and safety system of such firearms which are quite adequate in other respects than the above-identified problems.

Accordingly, it is one object of this invention to provide an improved rotary action safety assembly as an accessory feature that can be exchanged for sliding bolt type safety assemblies on available commercial firearms.

DISCLOSURE OF THE INVENTION

Therefore in accordance with this invention there is provided a safety accessory member in the form of a substantially cylindrical barrel member with a rotating lever extending therefrom for access and movement thereof without removing the trigger finger from the vicinity of the trigger for readiness to release the safety and ready the gun for firing. The barrel member is adapted for snugly fitting into a lateral bore through a firearm for rotation therein to replace, if desired, a prior sliding bolt type safety assembly. The lateral bore to achieve the advantages of this invention preferably is located rearwardly of the trigger in a trigger guard cage rear stop member adjacent the trigger to receive into the bore a trigger extension finger pivotable with the trigger only when the trigger is actuated in a rearmost position sufficient to release the firing pin. Thus, when the cylindrical bore is blocked by the barrel member the rearward trigger movement is stopped to prevent release of the firing pin.

Preferably the barrel member is of a self-lubricating plastic material which is indented to attain two stable positions respectively with safety on and with safety released. The barrel has an indentation mating with the trigger finger path of movement into said bore which is rotated into mating position in the "safety release" detent postion and out of mating position in the "safety on" detent position.

BRIEF DESCRIPTION OF THE DRAWINGS

Further features, objects and advantages of the invention will be found throughout the following description, which refers to the accompanying drawing, wherein:

FIG. 1 is a broken away right side view section of a firearm partly broken in section view to show the relationship of the essential safety assembly parts and features of the invention; and FIG. 2 is a plan view of a rotary actuated cylindrical barrel member for a safety assembly as provided in accordance with this invention.

DETAILED DESCRIPTION OF A PREFERRED EMBODIMENT

With reference to the accompanying drawing, portion 5 of a rifle such as a "Remington Model 760 Gamemaster" is shown in broken away section form to illustrate the operation of the trigger 6 upon a rotary action safety assembly operable by lever 7. The rotary action safety assembly is afforded by this invention as an accessory that will replace the axially sliding bolt action safety assembly of that rifle model without any modification or special preparation. The safety assembly is also adapted for use on other commercially available rifles and can be built into a new firearm as a piece of original equipment.

The rifle 5 is supplied with a pivoted rearwardly moving trigger 6 having at least one projecting trigger extension finger 8, 9 pivotable from pin 13 with the trigger 6 to move into the rearward cavity 15 of the trigger guard cage 10. The trigger encompassing guard cage 10 has a rearmost stop member 11 adjacent the trigger in its rearmost position limiting rearward pivoting motion of the trigger 6. The trigger 6 in its rearmost position will release the firing pin by mechanisms not shown.

A bore 12 extends laterally through the opposite surfaces of the rifle adjacent the trigger finger extension members 8, 9 so that the fingers 8, 9 extend into the bore when the trigger is at its rearmost position for releasing the firing pin.

A detent spring 16 and ball 17 is provided within cavity 18 and held in place by pin 19 for easy removal. This detent engages the safety mechanism within bore 12 at an intermediate lateral position along the bore, to thereby hold the safety in two stable positions respectively with the safety on in a first position so that the trigger cannot release the firing pin and with the safety released in a second position so that the rifle can be fired. Also it holds the safety barrel assembly 20 in the bore 12.

All of the foregoing is standard equipment in the above-identified rifle model, and there is added by this invention in a manner coacting with these elements in a different manner a safety assembly replacing an axially movable cylinder within bore 12.

Within the bore 12 is snugly fitted the generally cylindrical barrel member 20 for rotation therein over the limited arc defined by the two detent indentations 21, 22 as rotated by the lever 7. Preferably the rotating barrel member 20 is of a self-lubricating plastic material such as Dupont "nylon" or Celanese "Celcon" which is a glass filled acetate, thereby to avoid the necessity of lubricating metal-to-metal surfaces meeting in the bore.

Affixed to the barrel member 20 for rotation therewith is the integral lever arm 7 provided with a serrated frictional surface 30 which can be engaged by a finger for rotation from the shown position (detented at 21) to the alternate position (shown in phantom as detented at 22). In the shown position the surface of the barrel member 20 completely blocks both fingers 8 and 9 of the pivotable trigger 6 for any rearward motion that could release the firing pin, and is thus in a "safety on" condition.

Note that the entire contour area of the trigger fingers 8, 9 that would tend to enter the bore 12 are confronted completely by a mating solid barrel member surface area contacting the trigger fingers over its entire axial surface dimension through the bore. This is a firmer safer safety action than possible with the axially sliding cylinder assembly this safety assembly replaces which at best only contacts the mating surface of one finger 9 and places for less structural material in bearing with the trigger in the safe position.

When the safety lever 7 is rotated by finger pressure over the predetermined arc of rotation to attain the phantom position 7' where detent cavity 22 engages ball 17, then a receptacle cavity 35 of arcuate sector shape is placed in mating position to receive trigger extension fingers 8 and 9 in their rearmost position extending into bore 12, thereby providing a safety release position in which the rifle can be fired. Note that preferably the contour of the safety lever 7 matches that of the rearmost member 11 of the trigger guard cage 10 when in safety release position and extends rearwardly beyond the rearmost cage surface 36 for reach access when in the safety on position shown.

The lever 7 has in contact with the flat side surface 42 of the trigger cage 10 a flat bearing surface 40 of the barrel member 20 as confined in the bore 12 by action of the detent 17 to rest against the surface 42 of the guard cage rearmost member 11 for rotation. The opposite end of the barrel member 20 is a cylindrical portion substantially flush with the opposite surface of the trigger cage 10. Different levers are shaped for either right or left handed shooters to respectively extend from opposite sides of the bore 12.

The rotating barrel member 20 is confined in bore 12 against axial movement by the action of detent member 17 engaging the indentations in the barrel 20 as seen in FIG. 2, where the width of detents 21, 22 are substantially that of ball 17. The barrel may be removed by removing pin 19 and the detent mechanism.

It is significant that in operation a trigger finger may remain adjacent trigger 6 while the lever 30 is moved from its shown safety on position to the phantom safety release position. The middle finger may be used in this action. This permits a fast accurate sure safety release in the moment of excitement that game or a target appears if the safety is on, without the trigger finger having to attain an awkward position to keep the rifle in a specific state of preparedness for actuating the safety. Thus, the location of the bore 12 is critical and appears just rearward of the trigger in the guard cage rearmost member 11 so that access is natural and comfortable. For actuating the safety, fingers need not be held in unnatural or cramped position in cold weather thus tending to reduce the flow of blood and reducing mobility and effectiveness. The safety lever 7 as herein disclosed also can readily be returned to the safety on position in the similar way by reversing rotation of the barrel member 20, thereby providing a maximum degree of safety in not requiring the rifle to be moved or specially handled to reactuate the safety.

Accordingly, this invention having improved the state of the art, those features of novelty believed descriptive of the spirit and scope of the invention are defined with particularity in the claims which follow.

INDUSTRIAL APPLICATION

A readily accessible and easily manipulatable rotary acting safety assembly is provided for firearms. The safety can be operated with the trigger finger in the vicinity of the trigger and is simply manufacturable as an accessory to retrofit without firearm modification in existing gun models. Thus, it serves as a direct replacement for less accessible axially movable bolt safety assemblies. The safety assembly is also adaptable for design into original firearm equipment.

I claim:

1. In a firearm having a firing mechanism and a pivoted trigger lever carrying a finger rest located inside an encompassing trigger guard cage with a rearmost stop member adjacent the trigger finger rest rearmost pivoted position taken to release the firing mechanism, the improvement comprising a safety assembly operable to impede the pivotal movement of the trigger lever, said firearm having a cylindrical bore extending laterally therethrough to opposite surfaces at a position to the rear and adjacent said stop member, a trigger lever extension finger pivoted with the trigger lever to extend inside said bore only when the trigger lever is at the rearmost position for releasing the firing mechanism, said safety assembly comprising in combination, a rotatable generally cylindrical barrel member fittable into said bore for rotation therein and having affixed to the barrel member for rotation therewith and extending from one axial extremity thereof a rotatable safety lever arm adapted to rest on one surface of the firearm adjacent to and outside of said bore when the barrel member is inserted within the bore for manual actuation of the firearm user, frictional structure on the extremity of said lever arm for engagement by a finger of the firearm user to rotate said barrel member when within said bore over a predetermined arc and disposed in a first safety position in a direction rearwardly of said trigger lever, receptacle means in said barrel member disposed to mate with and receive said trigger lever extension finger in the trigger lever rearmost pivoted position at only a safety released position of rotation of said barrel member in said bore and structure on said barrel member preventing said trigger lever extension finger from entering said bore in the safety position of rotation of said barrel member, a detent mechanism engaging said barrel member to hold it selectively respectively in said safety position and safety released position within said arc of rotation provided by said lever arm, and means mounting said barrel member in said bore with said safety lever arm adjacent one firearm surface at said bore on one side of the firearm for solely rotary movement induced by movement of said safety lever arm to move in the two detented positions providing thereby respectively extending rearwardly from the trigger guard cage in the safety position where the firing mechanism cannot be released and extending adjacent alongside the trigger guard cage the safety release position where the trigger lever can release the firing mechanism upon appropriate manipulation of said rotatable lever arm while the trigger finger of the user is being held adjacent to the trigger lever.

2. The safety assembly as defined in claim 1 mounted in place on a firearm with the barrel member operatively mating with said trigger lever extension finger to permit release of the firearm in solely one of said two rotary detent positions of the barrel member.

3. The safety assembly as defined in claim 1 wherein the barrel member receptacle means comprises an arcuate sector shaped cavity in said barrel member.

4. The safety assembly as defined in claim 1 wherein the barrel member and safety lever arm extending therefrom comprise an integral member of self-lubricating plastic material.

5. The safety assembly as defined in claim 1 with a detent mechanism holding the barrel member in two positions namely a safety position and a safety release position wherein said trigger lever extension finger has a defined contour of predetermined area entering said cylindrical bore, and said barrel member presents in said safety position a surface contacting said contour in entirety over its axial dimension through said bore.

* * * * *